US006041718A

United States Patent [19]

Brandes et al.

[11] Patent Number: 6,041,718

[45] Date of Patent: Mar. 28, 2000

[54] CORRUGATED COLLAPSIBLE CONTAINER PACK

[75] Inventors: Michael J. Brandes, Jasper; Larry G. Besaw, *deceased, late of Jasper, both of Ind., by Sharon Montgomery, executor*

[73] Assignee: The Servants, Inc., Jasper, Ind.

[21] Appl. No.: 09/135,930

[22] Filed: Aug. 18, 1998

Related U.S. Application Data

[63] Continuation-in-part of application No. 08/760,225, Dec. 4, 1996, Pat. No. 5,794,542.

[51] Int. Cl.[7] ..... B65D 19/00

[52] U.S. Cl. ..... 108/51.3; 108/55.1

[58] Field of Search ..... 108/51.3, 56.1, 108/51.4, 55.1; 206/600, 306; 229/122.3, 122, 124, 126, 127, 185.1, 187, 190, 942, 100

[56] References Cited

U.S. PATENT DOCUMENTS

| | | | |
|---|---|---|---|
| 2,054,764 | 9/1936 | Berkowitz | 229/122.3 X |
| 2,083,114 | 6/1937 | Blechman | 229/122.3 X |
| 2,887,241 | 5/1959 | MacKenzie | 229/122.3 X |
| 2,989,226 | 6/1961 | Swartz | 229/122.3 X |
| 4,019,634 | 4/1977 | Bonnot | 229/122.3 X |
| 4,030,600 | 6/1977 | Heaps | 229/122.3 X |
| 4,860,912 | 8/1989 | Kupersmit | 229/122.3 X |
| 5,170,933 | 12/1992 | Perry | 229/122.3 X |
| 5,743,422 | 4/1998 | Hale | 229/122.3 X |
| 5,794,542 | 8/1998 | Besaw | 108/51.3 |

*Primary Examiner*—Jose V. Chen

*Attorney, Agent, or Firm*—Carrithers Law Office; David W. Carrithers

[57] ABSTRACT

A corrugated collapsible container pack is disclosed which include a tray having a front tray panel releasably attaching to a pair of tray side panels connecting to a rear central floor panel therebetween and structure to allow for releasably holding the front tray panel to the tray side panels. A lid having side edges bent downwardly forms a lid front panel releasably attaching to a pair of lid side panels. The releasable front tray panels and the releasable front lid panel are in alignment one with the other which defines structure to remove the front providing access to the contents without removing the lid.

48 Claims, 12 Drawing Sheets

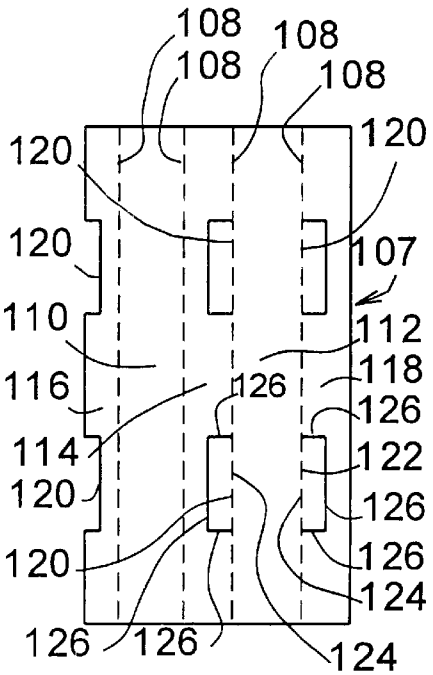
FIG. 14
FIG. 13
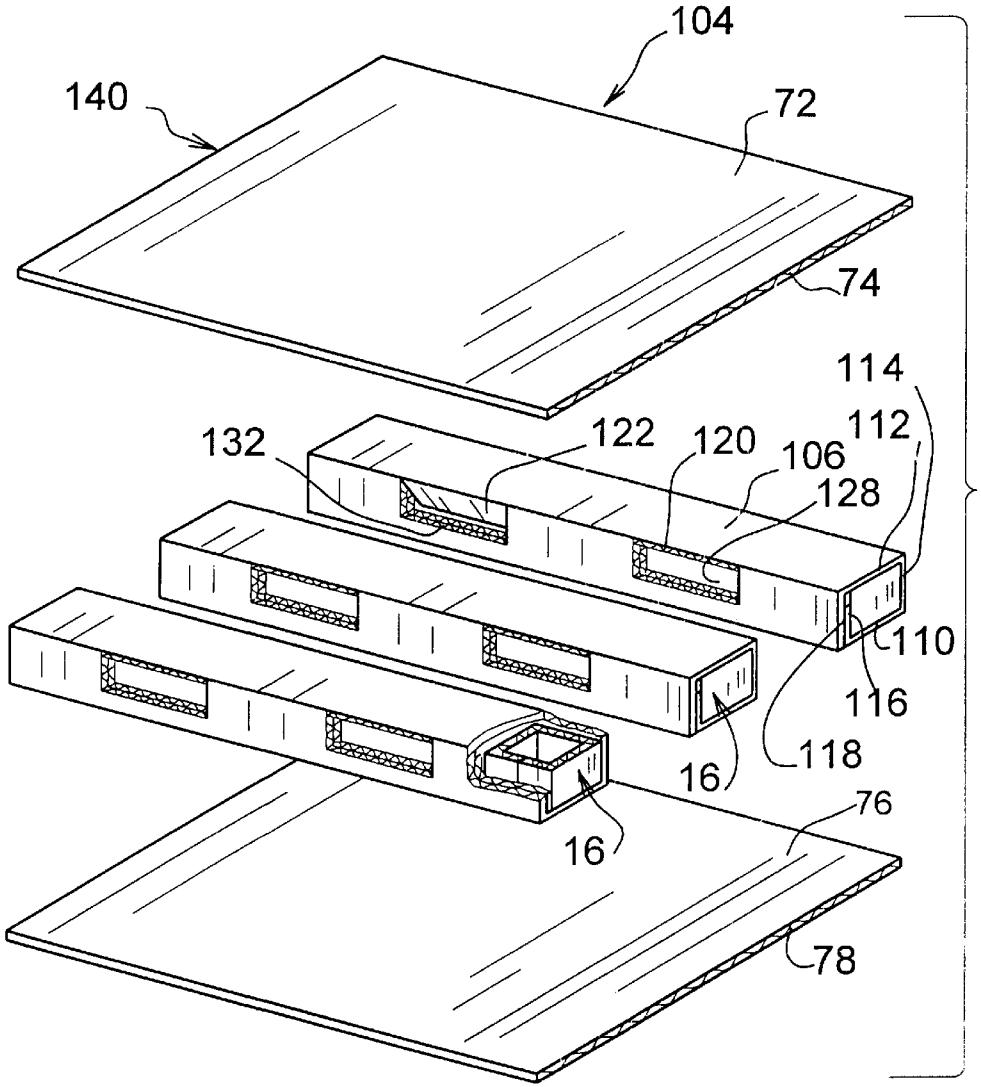

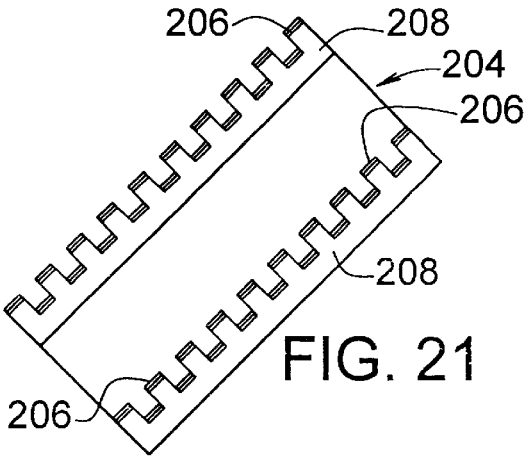
FIG. 21
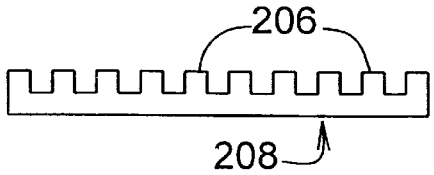
FIG. 22
FIG. 23
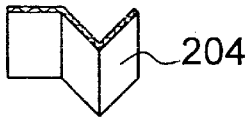
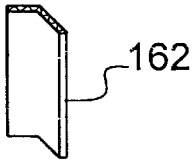
FIG. 24
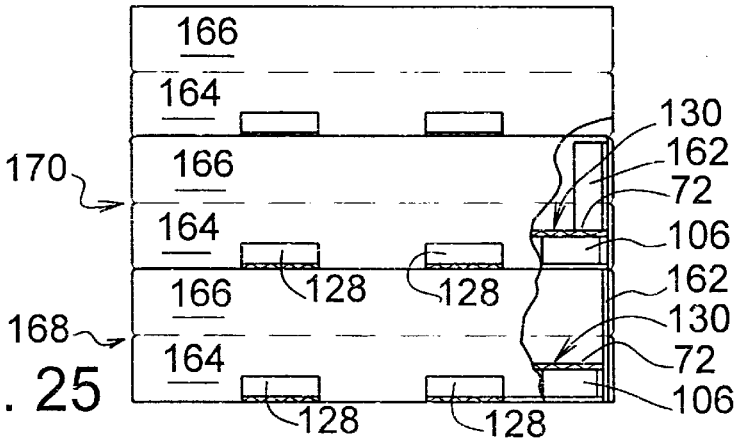
FIG. 25
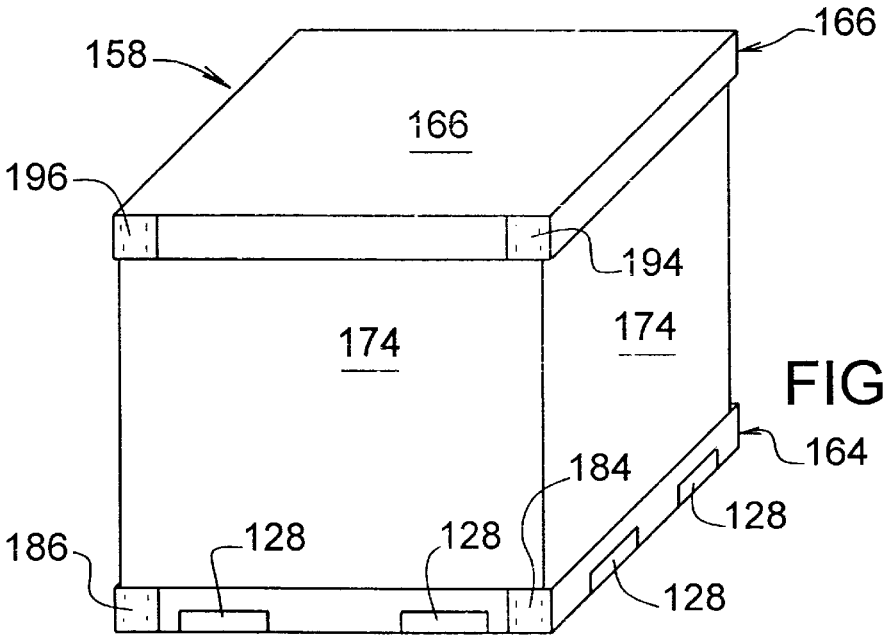
FIG. 26

CORRUGATED COLLAPSIBLE CONTAINER PACK

This is a continuation-in-part application of U.S. Pat. No. 5,794,542 filed on Dec. 4, 1996 and issued on Aug. 18, 1998.

TECHNICAL FIELD

This invention relates to a lightweight, high strength disposable or recyclable corrugated collapsible container pack providing a compact collapsed shipping container including an integral corrugated pallet and providing top or side access in the erected state.

DESCRIPTION OF THE PRIOR ART

Corrugated shipping containers are used as a method of handling materials in large quantities. The containers, are usually formed as large boxes typically comprise sidewalls, a bottom defining a flat surface for supporting materials packed therein, and a top sheet of cover. The shipping container is usually placed upon a wood pallet to provide a spacing and support means to allow for sufficient distance from the floor to permit the tines of the lift truck forks to be inserted under the pallet and shipping container thereon to support the load so it can be moved from place to place. Pallets used for this purpose are fabricated from wood, metal, plastic, or combinations thereof. Conventional pallets fabricated from these materials are expensive to make and use due to the cost of the materials, cost of construction, and cost of disposal. Usually these conventional types of pallets have to be returned after the shipment to the shipper for reuse or the pallets had to be disposed of in a proper manner. Deposal of the conventional wood and nail pallets is a problem after exposure to chemical or biochemical materials which contaminate the pallet in that not all of the pallet materials of construction are destructible by incineration and often must be disposed in a hazardous waste landfill which is inconvenient and expensive.

SUMMARY OF THE INVENTION

The lightweight, high strength disposable or recyclable corrugated collapsible container pack providing a compact collapsed shipping container providing top or side access in the erected state and including an integral corrugated pallet which can be erected without tools to provide a large bulk container which can be moved by a forklift and stacked for transporting or storage.

The present invention eliminates several of the disadvantages associated with the use of conventional wood pallets and provides for an integral internal pallet incorporated within the corrugated collapsible container pack. The collapsible container pack and integral pallet are comprised of inexpensive materials such as corrugated board or paperboard and an adhesive such as glue all of which may be generally recognized as safe, "GRAS", by the Food and Drug Administration, "FDA", so that they are recyclable, disposable in sanitary landfills, and inexpensive to manufacture. The corrugated collapsible container pack and integral pallet of the present invention is also easy to dispose of in case of contamination due to product spills or damage because all of the materials of construction are biodegradable and/or can be incinerated without further disassembly, yet they are reusable for many purposes. The corrugated collapsible container pack and pallet are light in weight and have great structural strength. Thus, the corrugated collapsible container pack and pallet of the instant invention are especially suited for commercial use of by consumers especially for applications such as moving goods whereby smaller conventional collapsed bags and/or boxes can be pre-stored within the corrugated collapsible container pack. The smaller bags and boxes may then be filled and placed in the corrugated collapsible container pack for shipping by truck or other means of transportation, thereby providing a container unit having an integral pallet which has the strength for containing the goods, and is designed to facilitate stacking with a fork lift for transporting and storage purposes.

Although it is contemplated that the collapsible container pack body of the present invention could be used with conventional pallets fabricated from corrugated material, wood, or plastic, the preferred embodiment of the present invention utilizes corrugated pallets described and claimed in Applicant's U.S. Pat. No. 5,535,668 and U.S. patent application Ser. Nos. 08/218,111, 08/358,145, and 08/760,225 hereby incorporated by reference.

The corrugated collapsible container pack of the present invention includes a tray having a front tray panel releasably attaching to a pair of tray side panels connecting to a rear central floor panel thereinbetween and means for releasably holding the front tray panel to the tray side panels. A pallet is disposed within the tray. The pallet is preferably fabricated from corrugated paper material; however, pallets fabricated from plastic, wood, or combinations thereof could be used therein. A front wall panel is removably attached to at least one side wall panel connecting together to form an enclosure with means for releasably holding the front wall panel to the at least one side wall panel. The embodiment may include one large wall panel having two folds to form a back wall panel with side wall panels to connect to the front panel or the back and side wall panels may be formed separately and connected together by fastening means. A lid having side edges bent downwardly forms a lid front panel releasably attaching to a pair of lid side panels which connects to a lid rear panel thereinbetween and includes means for releasably holding the front lid panel to the pair of lid side panels. The releasable front tray panel and the releasable front lid panel are in alignment one with the other defining means for releasing the removable front wall panel providing access to the contents stored within the corrugated collapsible container pack during the erect position without removing the lid.

One embodiment of the corrugated pallet of the present invention comprises a support surface consisting of at least one flat sheet of single or double ply corrugated material supported by a plurality of supporting members or legs formed from corrugated material. In one preferred embodiment, "I" shaped perforations are formed and interconnected with straight score lines along a template formed in the flat sheet of material. Aligning and pressing the support members through the primary support sheet detaches the cut portions of the panels integrally formed therein which biases the panels forming flaps extending against opposite sides of the support members. Coating of the template prior to insertion of the support members through the scored panel formed in the primary support sheet provides a means of simultaneously applying an adhesive between the panels and the support members.

Another embodiment of the corrugated pallet of the present invention entails a corrugated pallet comprising a primary support sheet surface of flat corrugated material having a plurality of opposing panels formed therein. The opposing panels are hingeably connected to the primary support sheet. Each of the opposing panels are folded downward normal to the surface of the primary support panel to define a supporting leg. A support member is fastened in between or around each of the support legs, wherein the support member comprises a strip of corrugated material having a plurality of scores cut therein for bending the strip into a square or block complementary sized for insertion into or around the supporting legs, and extending the length of the supporting legs. Moreover, a means such as an adhesive is provided for fastening the support members to the support legs providing multiple layers of single or multiple ply corrugated material for supporting the load bearing primary support panel.

The preferred embodiment of the present invention consists of a corrugated leg-wrap pallet comprising a support surface comprising at least one multi-ply corrugated sheet, and at least two leg-wrap support members secured to the bottom of the support surface. The leg-wrap support members comprise a multi-ply corrugated sheet having a plurality of spaced apart parallel score lines formed therein with the sheet being folded inwardly forming creases along the score lines and at least five panel sections thereinbetween forming a generally rectangular shaped conduit having at least two of the panel sections overlapping and secured together. Moreover, the leg-wrap support has at least two spaced apart and aligned transverse slots formed through the sides of the leg-wrap support normal to the longitudinal axis of the leg-wrap support complementary sized and shaped and adapted to accommodate the tines of a lift truck. A plurality of generally square corrugated support members are disposed inside of the leg-wrap support and positioned between the slots for additional structural support.

The corrugated leg-wrap pallet may have a support surface extended in length and having a pair of spaced apart parallel score lines forming an inner side panel and outer side panel on each side of the support surface. The inner side panel and the outer side panel may be folded inwardly and wrapped around the leg-wrap support members forming side rails supports extending along each side of the support surface.

The corrugated collapsible container pack and integral pallet is fabricated by placing one of the aforementioned corrugated pallets into a corrugated tray. The corrugated tray is prepared by cutting and scoring a corrugated sheet having cutouts at predetermined position to accommodate the tines of a fork lift extending therethrough and in under the corrugated pallet. The edges of the tray are folding the edges upwardly forming a lip and attaching the corners of the edges together with means for attachment such as glue, staples, hook and loop fasteners, or combinations thereof. The sides of the collapsible container pack are formed from a pair of opposing die cut and scored corrugated sheets having slots cut therefrom to match the position of the openings formed in the corrugated pallet and tray edges. The sides could be formed in a single sheet; however, as opposed to conventional shipping containers, at least one of the sides is left open to accommodate a side panel which is utilized as a removable door during utilization of the collapsible container pack to provide the user with a means to access the collapsible container pack at times during storage when material is stacked upon it. An important feature of the present invention involves the use of corner reinforcement members which supported the corrugated collapsible container pack at a selected height during shipment and can be utilized as internal support members within the container pack during the erected state, or provide an external support to cushion tie-bands used to hold the container pack together during shipping.

The collapsible container requires no tools for set up or knock down, nor does it require the use nails, screws, metal fasteners or staples; thereby keeping the terminal yard nail free saving on punctured tires. The collapsible container is 100% recyclable. All of the paper construction can be baled or put through a paper "hogger" and remanufactured into corrugated products. Furthermore, the collapsible corrugated container is environmental friendly using a minimum of 35% recycled paper.

The collapsible container is manufactured to meet or surpass military standards as set forth by military standard MIL-STD-105 and supersede federal specification PPP-B-580-C for household goods.

Accordingly, it is a principal object of the present invention to provide a disposable and recyclable corrugated collapsible container pack and integral pallet of the lowest possible cost while maximizing its strength and durability.

It is an object of the present invention to provide a disposable collapsible container pack and integral pallet capable of manufacture solely from lightweight sheet material such as corrugated board and an adhesive.

It is an object of the present invention to provide a container whereby the individual parts, when damaged, are easily replaced allowing more turns in the distribution system.

It is an object of the present invention to provide a container which can be set up by one person in less than ten minutes.

It is an object of the present invention to provide a container which weights one-half the weight of a comparable volume liftvan. For instance a unit providing 206 cubic feet of space weights about 175 pounds.

It is an object of the present invention to provide a corrugated collapsible container which opens on either end providing a removably detachable panel without removing the lid.

It is an object of the present invention to provide a corrugated pallet utilizing corrugated leg wrap support members having corrugated support members therein to support the corrugated collapsible container pack high enough above a surface to accommodate fork lift tines.

It is another object of the present invention to construct the pallet with the supporting members being positioned to dissipate the weight of the load on the pallet evenly.

It is another object to construct the pallet so that it will sustain loads to which it is subjected and not fold or bend sideways in movement or shipment.

It is another object of the present invention to provide a corrugated collapsible container pallet which is less than ½ its erected height when collapsed and which provides sufficient structural support to maintain structural integrity upon being stacked for shipment or storage.

It is yet another object of the present invention to provide a corrugated collapsible having at least one removable side panel which can be removed with the pallet in the stacked position providing access to the goods stored therein.

It is yet another object of the present invention to provide a vertical support member having a selected length to utilize in the corrugated collapsible container pack during shipment in the collapsed state to protect the goods inside, whereby the vertical support member may be used internally for support or externally as a protection, support, and cushioning means when used in combination with binding ties.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 13 is an exploded perspective view showing a corrugated leg-wrap pallet in accordance with the present invention having a single multi-ply corrugated support sheet and single layer base sheet, and showing a cut-away view of one of the leg-wraps showing a support member disposed therein;

FIG. 14 is a top plan view of the corrugated panel of FIG. 13, showing a leg-wrap having the score lines shown in phantom lines;

FIG. 21 is a perspective view of a corrugated separator sheet which may be utilized in the corrugated collapsible container pack;

FIG. 22 is a side view of a corrugated separator sheet which may be utilized in the corrugated collapsible container pack;

FIG. 23 is a perspective view of a compressible corrugated spacer strip which may be utilized in the corrugated collapsible container pack;

FIG. 24 is a perspective view of a corrugated corner protector strip which may be utilized with the corrugated collapsible container pack;

FIG. 25 is a front view of a stack of collapsed corrugated collapsible container packs showing a partial cutaway view to reveal the use of the vertical support resting on the surface of a leg wrap support pallet and recesses adapted for insertion of the tines of a fork lift;

FIG. 26 is a perspective view of an erected corrugated collapsible container pack;

DESCRIPTION OF THE PREFERRED EMBODIMENT

The instant invention is a corrugated collapsible container pack and integral pallet fabricated from low weight, high strength disposable or recyclable corrugated material providing a compact collapsed shipping container including an integral corrugated pallet and providing top or side access in the erected state.

The preferred embodiment utilizes corrugated leg wrap supports having a sheet of corrugated material having a plurality of score lines folded inwardly forming a generally rectangular conduit support member are used in combination with at least one corrugated sheet to form a corrugated pallet. Within the hollow conduit of the leg wrap supports, individual support members are formed from one or more layers of a narrow strip of corrugated material having a plurality of scores cut therein along the surface of one side for bending the strip into a generally square configuration.

The flutes of the corrugated material comprising the support member and opposing panel support legs are oriented in the vertical plane to maximize the strength to weight ratio.

It is contemplated that the instant invention could be fabricated from plastic material as well as other types of paperboard.

The various embodiments of the corrugated pallet utilized in the present invention shall be described in detail and then described in combination with the container features.

CORRUGATED PALLET

The corrugated pallet 10 of the present invention is designed using one of more layers of single or multiple plies of semi-rigid material such as corrugated board, fiberboard, corrugated plastic sheets for the fabrication of inexpensive disposable skids. It is contemplated that the sheet material may be coated with oil, wax, a surfactant, or a polymer film to repel moisture. The semi-rigid material is typically cut into sheets and strips of material fastened together preferably with an adhesive, such as a glue, or by staples, rivets, or other fastening means. The sheet material is fed into a die which makes the cuts and score lines for the number of foldable panel legs required for the load capacity of a particular pallet.

Figure 1:
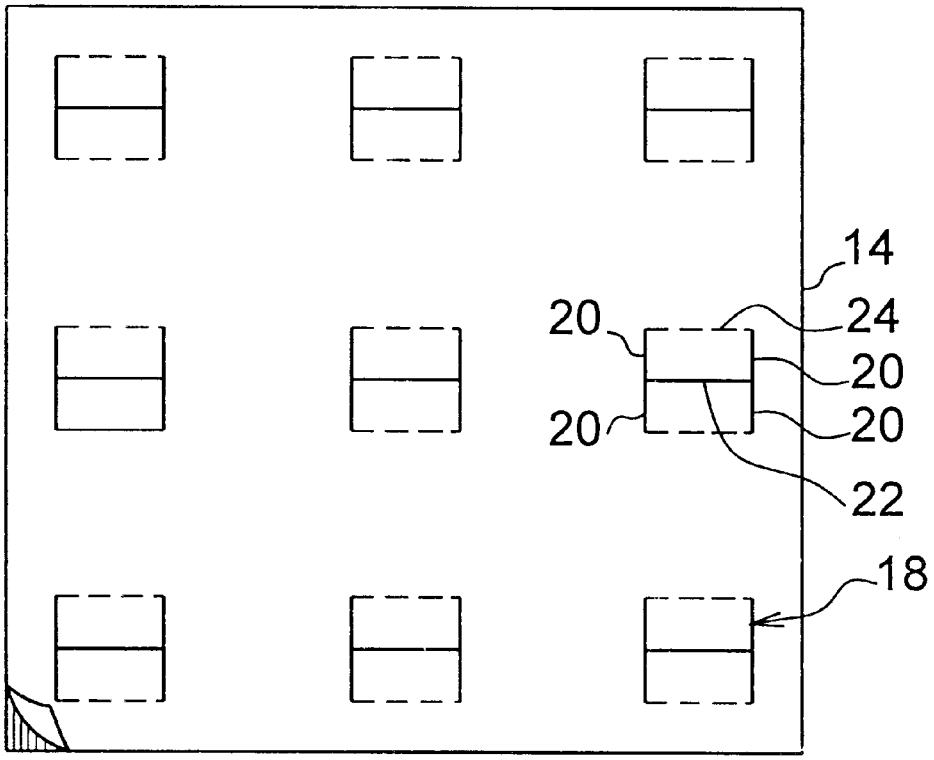
FIG. 1 is a plan top view showing the perforations cut through and scores lines formed in the surface of a corrugated sheet of material forming a template in the primary support sheet of the present invention.

As shown in FIG. 1, a preferred embodiment of the present invention comprises a single sheet corrugated pallet 12 having at least one first primary support sheet 14 comprising a single sheet of fluted single, double, triple, quadruple, or multiple plies of corrugated board supported by a plurality of support leg members 16. FIG. 1 shows the primary support sheet 14 of one preferred embodiment including a plurality of foldable panels 18 each one being defined by a pair of parallel cut lines 20 on each side opposite one another and intersecting with a center cut line 22 in the general shape of an "I". Moreover, perforations forming score lines 24 are formed in the primary support sheet 14 intersecting the distal ends of each of the cut lines 20 for hingeably joining the generally rectangular or square panels 18 formed therein to the primary support sheet 14.

Figure 2:
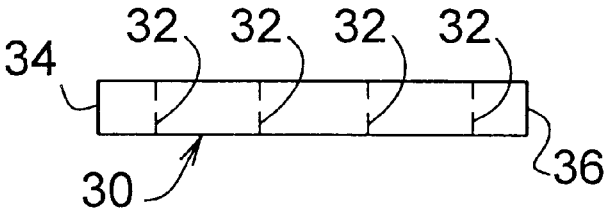
FIG. 2 is a front plan view showing a strip of corrugated material having a plurality of perforations and scores therein for foldably forming a support member of the present invention.
Figure 3:
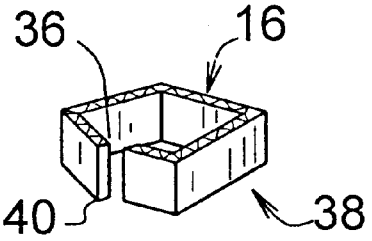
FIG. 3 is an elevational perspective view of a support member of the present invention.
Figure 5:
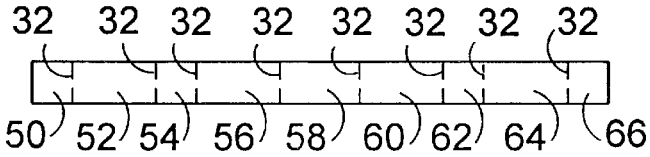
FIG. 5 is a front plan view showing a strip of corrugated material having a plurality of perforations therein forming score lines for foldably forming a support member having a reinforcement of a single sheet corrugated pallet.
Figure 6:
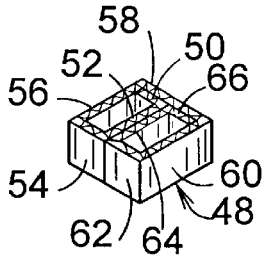
FIG. 6 is an exploded perspective view showing a reinforced support member of a single sheet corrugated pallet.
Figure 7:
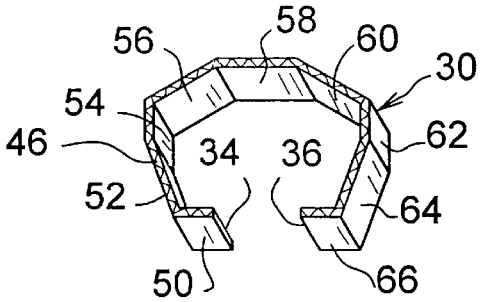
FIG. 7 is an elevational perspective view showing a reinforced support member of a single sheet corrugated pallet.

The support members 16 are likewise made of strips 30 of double fluted corrugated board having four score lines 32 spaced apart from one another normal to the longitudinal axis as illustrated in FIGS. 2 and 3. The strips 30 are folded into square or rectangular formation so that the distal ends 34 and 36 respectfully join at a point 40 between the corners, preferably in the center section of the square support member 16. The wall thickness and size of the support members 38 vary depending upon the weight of the load supported and the number of support members 16 utilized. As best illustrated in FIGS. 4–10, exertion of pressure upon the surface of the panel template by insertion of a support member 16 forces the foldable panels 18 downward opposite one another and normal to the surface of the primary support sheet 14 forming a pair of opposing panel legs 26. The support members 16 are rotated and positioned between the panel legs 26 so that the point 40 of junction of the distal ends 34, 36 of the support member 16 are adjacent and contiguous with one side of one of the foldable panels 18.

The support members 16 may be attached to the panel legs 26 by various fastening means such as by staples, rivets, tape, interlocking tabs, or clips; however, in the preferred embodiment, a glue, preferably a water soluble glue, is used as an adhesive to hold the opposing panel legs 26 securely to the support members 16. In the preferred embodiment, the support leg members 16 are sized and shaped to provide a complementary fit with the panel legs 26. Insertion of the support members 16 within the panel legs 26 provides a reinforcing structure in that the depth of the support member 16 extends the length of the panel legs 26 and the thickness of the primary support panel 14 in order to provide optimal support for the load such as best shown in FIGS. 1–11. Surrounding or wrapping the panel legs 26 with a support member 16 provides a reinforcing structure in that the depth of the support members 16 extends the length of the panel legs 26 less the thickness of the primary support panel 14, so that the top edge of the support members 16 support the bottom surface of the primary support panel 14 around the opening formed by the panels 18 to provide optimal support for the load and alleviate stress at the junction of the panel legs 26 to the primary support panel 14. However, it is contemplated that the support members 16 may be of a depth of either more or less than that of the primary support panel providing lateral side to side support and providing an edge or sidewall between the panel legs 26 and the supporting member to facilitate stacking of the corrugated pallets 10 one upon another.

Figure 4:
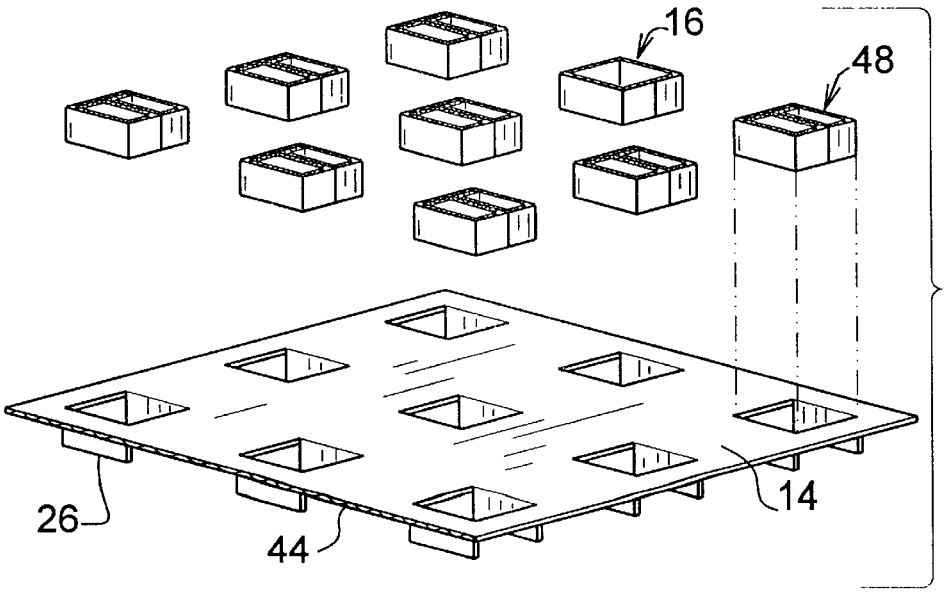
FIG. 4 is an exploded perspective view showing alignment of the reinforced support members with the panels formed within the primary support sheet of a single sheet corrugated pallet.
Figure 8:
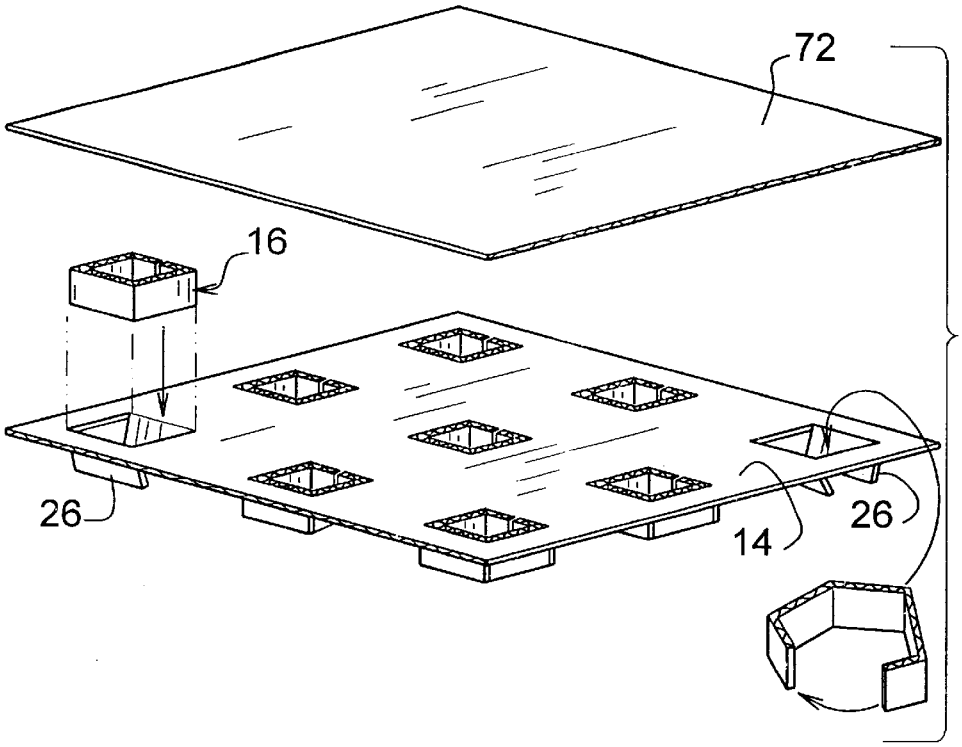
FIG. 8 is an exploded perspective view showing alignment of a support member between the panels formed in the primary support sheet and the alignment of a top cover sheet forming a double sheet laminated corrugated pallet.
Figure 9:
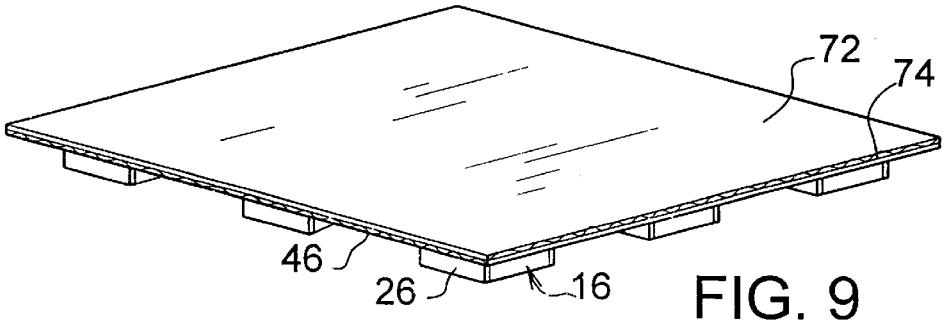
FIG. 9 is an elevated perspective view showing a double sheet laminated corrugated pallet of FIG. 16.
Figure 10:
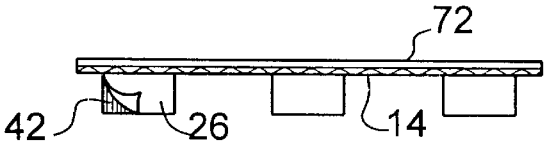
FIG. 10 is an elevational end view of the double sheet laminated corrugated pallet showing the orientation of the panel lutes of the top sheet in alignment perpendicular with respect to the lutes in the primary support sheet.
Figure 11:
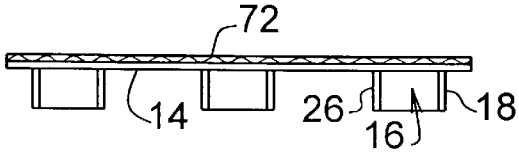
FIG. 11 is an elevational side view of the double sheet laminated corrugated pallet showing the edges of the panels attached to the support members.

Moreover, as shown in FIG. 4, an adhesive such as water soluble or biodegradable glue is applied to the template surface of the primary support sheet 14 before insertion of the support member 16. Insertion of the support members 16 through the primary support panel 14 distributes the adhesive onto the surface of the support members 16 as the support members 16 are pushed through the marked template. FIG. 10 shows a side view of a single sheet corrugated pallet 12 showing the leg panels 16 secured to opposing sides of a support member 38. FIG. 11 shows an end view of a single sheet corrugated pallet wherein the flutes 42 of the foldable panels 18 are aligned with the flutes 44 of the primary support sheet 14 so that the foldable panel flutes 42 extend normal to the supporting surface.

FIGS. 3–11 shows a plan top view of flutes 36, 46 of the support members 16, 48 extending through the primary support sheet 14. Furthermore it is contemplated that several layers of multiple ply sheets may be adhesively connected forming layers of corrugated sheets in combination with the primarily panel 14 and support members 16 having multiple layers of fluting to provide the desired strength required for a particular load carrying application.

FIGS. 4–7 show of a reinforced support member 48 fabricated from a strip 30 of corrugated material having eight score lines 32 extending normal to the longitudinal axis of the strip 30 forming strip sections (50, 52, 54, 56, 58, 60, 62, 64, and 66). The distal ends 34 and 36 are folded inwardly so that the outer surface of strip sections 50 and 66 are contiguous with and adhesively secured to the inner surface of strip section 58 thereby forming a "T"-shaped double layer reinforcing means within the reinforced support member 48. The reinforced support members 48 may be inserted into the primary support panels 14, 48 instead of, or in addition to the square support members 16 such as is shown in FIG. 13. Insertion of the support members 16, 48 through the sheets 14 and 68 depresses the foldable panels 18 downwardly and simultaneously spreads the adhesive from the surface of the first primary support panel 14 and/or second primary support panel 68 onto the outer surface of the support member 16 to securely hold the support member securely thereinbetween the four panel legs 26.

Figure 16:
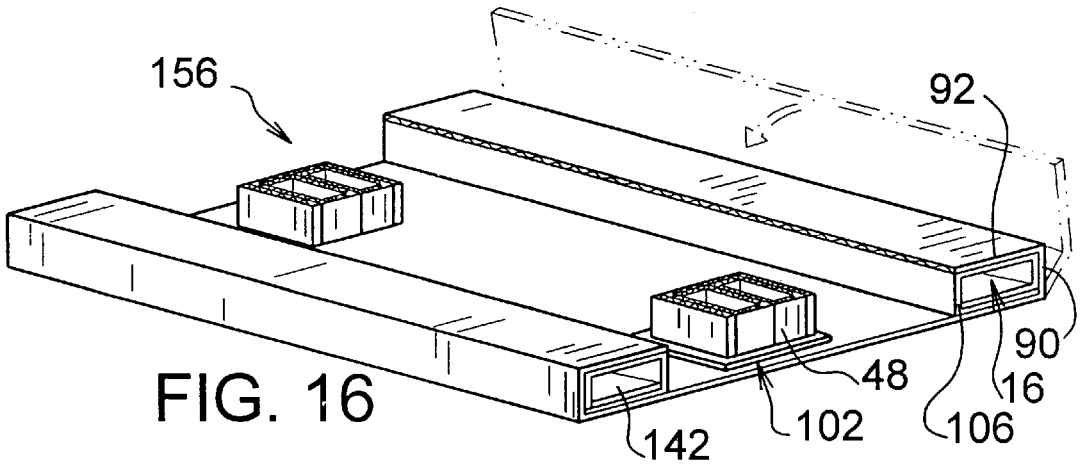
FIG. 16 is a perspective view showing the bottom portion of a leg-wrap corrugated pallet made in accordance with the present invention having base members adhesively secured along the central portion thereof and showing in phantom lines the ends of the support panel being folded inwardly around the leg-wrap supports.

As shown in FIGS. 8–11, an alternate embodiment employs a first top double fluted multi-ply laminate support sheet 72 as a top cover sheet adhesively bonded to the surface of the primary support sheet 14, 68, and the fluted edges 46 of the corrugated support members 16, 48. The top support sheet 72 is usually rotated 90 degrees before adhesion to the primary support sheet 14 or 68 so that the laminate sheet flutes 74 run perpendicular to the primary support sheet flutes 44 to maximize the strength of the corrugated pallet 10 as shown in FIG. 16. The primary support sheet flutes 44 run parallel with the foldable panel flutes 42.

Figure 12:
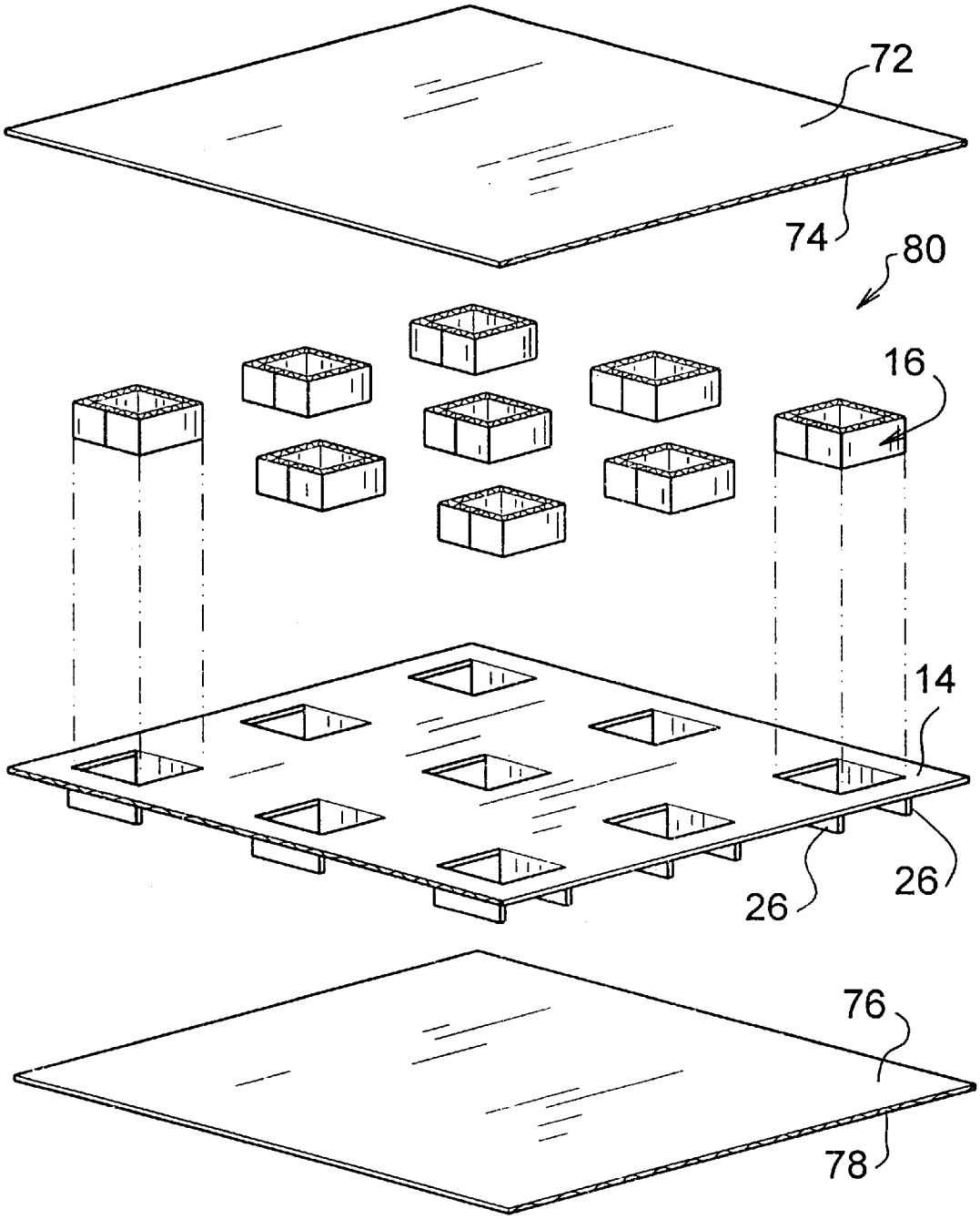
FIG. 12 is an explored perspective view showing alignment of a support member between the panels formed in the primary support sheet, and the alignment of a top cover sheet and bottom base sheet forming a triple sheet laminated corrugated pallet.

Moreover, as shown in FIG. 12, a fluted multi-ply base sheet 76 may also be adhesively secured to the edges of the panel legs 28 and edges of the support members 16 secured therein forming a triple sheet corrugated pallet 80. As with the top sheet, the base sheet 76 is usually rotated 90 degrees before adhesion to the primary support sheet 14, 68 so that the laminate sheet flutes 74 run perpendicular to the primary support sheet flutes 44 to maximize the strength of the triple sheet corrugated pallet 80. The first laminate sheet flutes 74 run parallel with the base sheet flutes 78 opposite the primary support sheet flutes 44 and foldable panel flutes 42 as shown in FIGS. 22–24.

Figure 17:
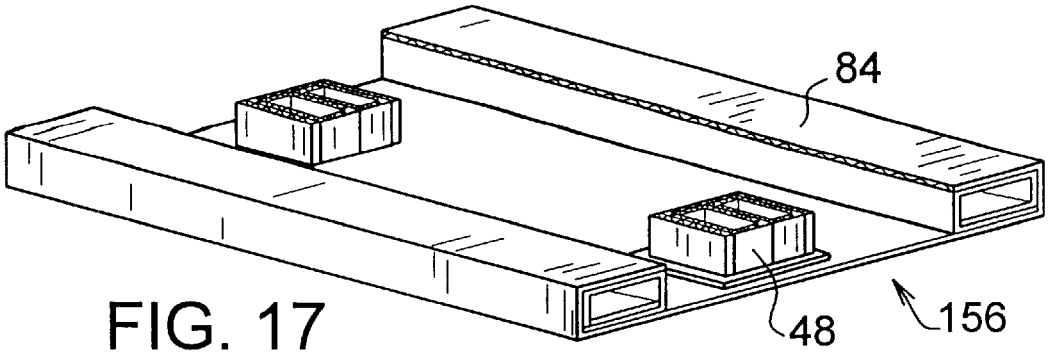
FIG. 17 is a perspective view showing the corrugated leg-wrap pallet of FIG. 67 having side rails formed around the leg-wrap supports.

FIGS. 13 and 16–17 illustrate multi-layered leg-wrap corrugated pallets having longitudinal leg-wrap support members 106 extending the entire length of the corrugated pallets. The leg-wrap corrugated pallets 104 provide utilize longitudinal support means extending across the width of the pallet 10 and are adapted for portably moving extending the tines of a fork lift between the leg-wraps 106 and/or through passageways formed through the leg-wraps 106.

As shown in FIGS. 13 and 14, the leg wrap support members 106 are fabricated by scoring a multi-ply corrugated leg-wrap sheet 107 on one side and bending the sheet 107 around the plurality of spaced apart and parallel scores forming creases 108 therealong and panel sections there inbetween. The creases 108 separate the corrugated sheet 107 into wide top and bottom panel sections having alternating narrow side sections thereinbetween. More particularly, a first wide panel section 110 and second wide panel section 112 are hingeably connected together by a first narrow side panel section 114 positioned thereinbetween. A second narrow side panel section 116 is hingeably connected to the first wide panel section 110, and a third narrow side panel section 118 is hingeably connected to the second wide panel section 112. A holding means, such as a pressure sensitive adhesive or water soluble glue, is applied between the outer narrow side panel sections 116 and 118 and the panel sections joining them together and forming the rectangular shaped leg-wrap supports 106.

Furthermore, transverse slots 120 or transverse slots with break-away flaps 122 may be formed in the leg-wrap supports 108 simultaneously with the scoring process. The flaps 120 and slots with flaps 122 are adapted to accommodate the tines of a fork lift truck.

The slots with flaps 122 are formed by creating score lines 124 into and cuts 126 through the corrugated sheet 107 as best shown in FIGS. 41–44. The slots 120 are formed by stamping cuts 126 through the corrugated sheet 107. The panel sections 110–118 are folded along the creases 108 into position aligning the slots 120, 122 formed therein providing a generally rectangular shaped passageway or conduit 128 extending normal to the longitudinal axis of the leg-wrap 108 through the vertical side panel sections 114–118. The slots 120, 122 are sized to provide the necessary clearance according to the width and thickness of a typical fork lift tine. The slots 120, 122 are formed in the top portion of the narrow side panel sections 114–118 so that lift truck forks inserted into the slots 120, 122, lift upwardly distributing the upward force on the underside of the wide top panel section 110 of the leg-wrap 106.

The leg-wrap corrugated pallet 104 shown in FIG. 13, incorporates at least two leg-wraps 106, and preferably three leg-wraps 106, spaced apart in parallel alignment. The leg-wraps 106 may be attached to a support surface comprising sheets or panels by using holding means such as staples, rivets, tape, interlocking tabs formed therein, etc.; however the preferred attachment means is by use of a biodegradable adhesive such as water soluble or solvent soluble glue. The leg-wraps 106 may also be fabricated having a pressure-sensitive adhesive backing 96 covered with a nonstick film, or waxed paper material 98 forming an independent leg-wrap support 106 attachable to the bottom of any type of skid or pallet 10 for additional structural support.

Figure 15:
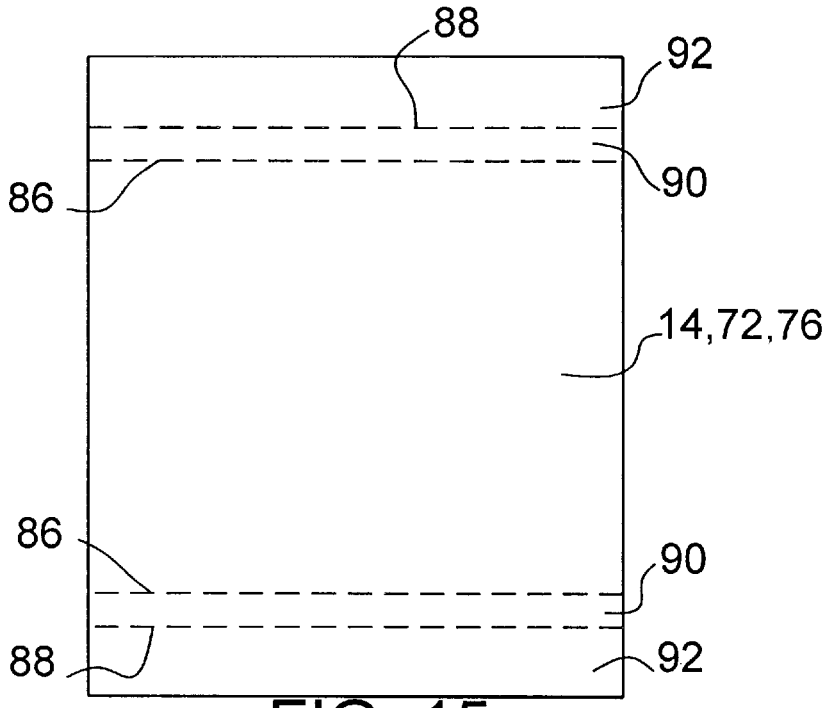
FIG. 15 is a top plan view of a corrugated support sheet having spaced apart parallel score lines formed therein and positioned near each end.

A multi-ply corrugated base sheet 76 may be attached by holding means, such as by an adhesive, to the bottom surface of the leg-wraps 106 of the single layer leg-wrap corrugated pallet 130 shown in FIG. 13 to form a corrugated leg-wrap sandwich pallet 140. The base sheet 76 is usually aligned so that the base sheet flutes 78 run perpendicular to the leg-wrap flutes 132 to maximize the strength of the leg-wrap sandwich pallet 140. As shown in the FIG. 15, the corrugated support sheet 72, 76 is perforated with a pair of spaced apart parallel score lines consisting of inner score line 86 and outer score line 88 forming an inner panel 90 and outer panel 92 on each side of the support sheet 72, 76 forming creases therein. As shown in FIGS. 16–17, leg-wraps 106 and/or conduit supports 142 are inserted and adhesively affixed to the bottom of the support sheet 72 or base sheet 76. The inner panels 90 and outer panels 92 are folded inwardly around the leg-wraps 106 or conduit supports 142 forming side rails 84 on each side of the corrugated pallet 10. It is contemplated that additional support sheets 72 and/or base sheets 76 may be used in combination with the corrugated pallet 156 having side runners 84.

As shown in FIGS. 18–31, the corrugated collapsible container pack 158 of the present invention includes an integral corrugated pallet as described heretofore. Preferably a leg wrap support pallet 130 such as is shown and described in FIG. 13 and has conduits 128 to accommodate the tines of a fork lift extending through the sides of the leg wrap supports 106 as well as inbetween them. The support sheet 72, 74 of the preferred embodiment may optionally include cutaway corners 160 to provide a recess to accommodate the multiple layers of corrugated sidewall corners which must be overlapped at the corners of the collapsible container pack 158 to provide side access. The cutaway corners 160 optionally provide a means for corrugated vertical support members 162 such as shown in FIG. 75 to fit between the pallet 130 and the sidewall of the container pack 158 so that the bottom of the vertical support members 162 rests upon the tray 164 bottom surface 165.

Figure 20:
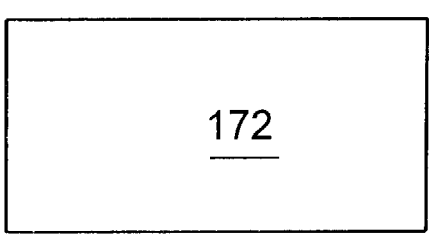
FIG. 20 is a top view of a corrugated sheet which may be utilized in the corrugated collapsible container pack.
Figure 19:
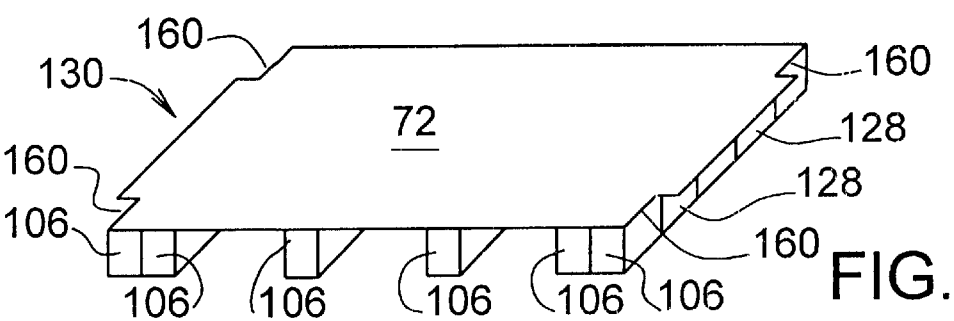
FIG. 19 is a perspective view of one embodiment of a corrugated pallet utilized in the corrugated collapsible container pack.

FIG. 25 which shows a several corrugated collapsible container packs 158 in the collapsed state stacked one upon another. As shown in FIG. 25 the vertical support members 162 may rest against the tray 164 bottom 165 and support the lid 166 as best illustrated by collapsed container pack 168. An additional support sheet 172 such as shown in FIG. 20 may be placed upon the surface of sheet 72 to provide support for the vertical support members 162. The vertical support members 162 may also support the lid 166 by extending downward to rest upon the top surface of the support sheet 172 placed upon sheet 72 of the leg wrap support pallet 130 as shown in the collapsed container pack 158.

Figure 18:
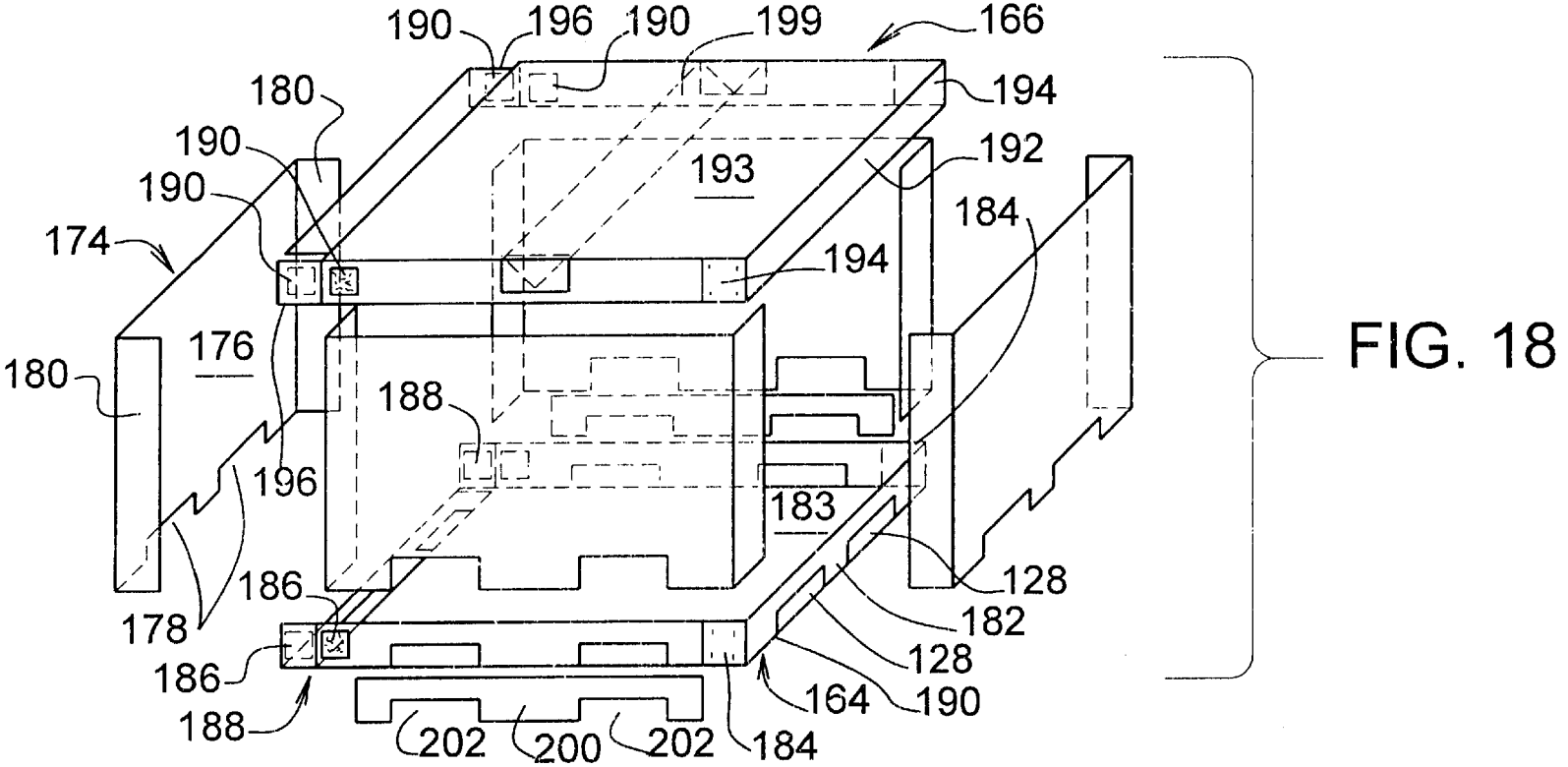
FIG. 18 is an exploded perspective view of the corrugated collapsible container pack showing the components thereof.

The corrugated collapsible container pack 158 may be fabricated using a single die cut sheet with score lines to form the side sections having a single joint. However, as shown in FIG. 18, the preferred embodiment includes four opposing side wall sheets 174 having vertical score lines near the outer edges. Bending the outer edges of the side wall sheets 174 inwardly forms a center panel 176 having a pair of fork lift cutouts 178 and a pair of side panels 180 which overlap.

Figure 34:
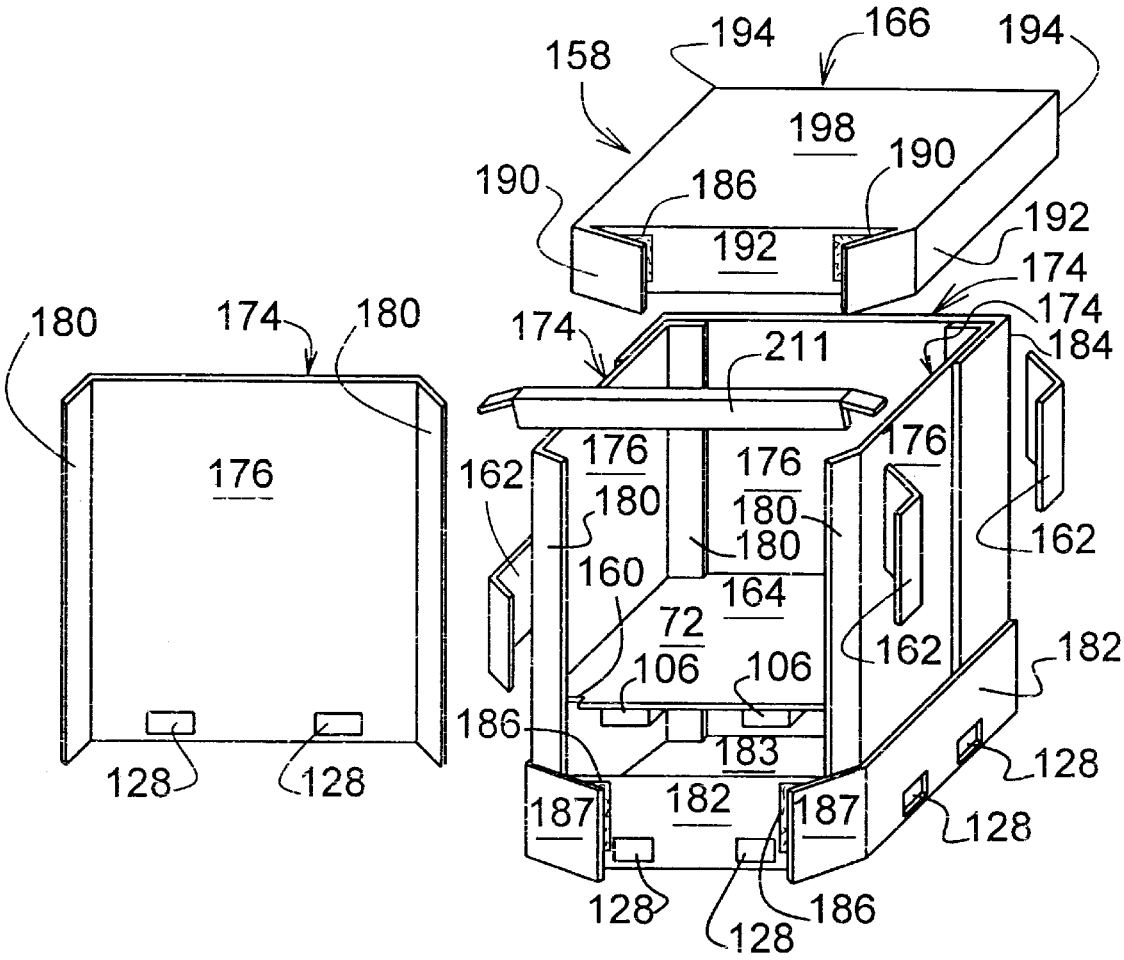
FIG. 34 is a perspective view of an alternate embodiment of the corrugated container pack of the present invention.

The corrugated collapsible container pack 158 of FIG. 34 is similar to that of FIG. 18; however, the vertical panels 182 extending upwardly from a bottom tray floor panel 183 include folding front panels 187 which fold inwardly over the vertical panels 182. Moreover, one or more spreader bars 211 are extend normal to the removable front panel 174.

A pallet having at least one single corrugated sheet supported by support means such as feet 16, leg-wraps 106, or other plastic or corrugated pallets are used to form the bottom tray 164 of the container pack 158. The sheet has score lines extending near the outer edges, and score lines and die cuts formed in each of the corners to facilitate folding the outer edge of the sheet upward defining vertical panels 182 extending upwardly from a bottom tray floor panel 183 and attaching the corner of the vertical tray panels 182 with a means for holding such as an adhesive or staples forming permanently secured corners 184 on one end of the tray 164. Removable means of attachment such as a hook and loop fastener 186, (often sold under the tradename of VELCRO®), is used to secure the two detachable corners 186 opposite the secured corners 184 so that the tray panel 182 can be pivoted to the horizontal position providing a flat surface. The secured vertical tray panels 182 form a tray lip 188 extending around the periphery of the tray 164.

A single corrugated sheet is used to form the top lid 166. The sheet has score lines extending near the outer edges, and score lines and die cuts formed in each of the corners to facilitate folding the outer edge of the sheet downward defining vertical lid panels 192 extending downwardly from a lid center panel 193 and attaching the corner of the vertical lid panels 192 with a means for holding such as an adhesive or staples forming permanently secured corners 194 on the same end of the top lid 166. Removable means of attachment such as a hook and loop fastener 190, (often sold under the tradename of VELCRO®), is used to secure the two detachable corners 196 opposite the secured corners 194 so that the lid panel 192 can be pivoted to the horizontal position providing a flat surface. The secured vertical lid panels 192 form a lid lip 198 extending around the periphery of the tray 164. The secured corners 194 of the lid 166 are placed in vertical alignment with the secured corners 184 of the tray 164 providing four secured corners 184, 194 on one end of the container pack 158 and four detachable corners 186, 196 on the opposite end to facilitate removal of the contents of the container pack 158 without removing the top lid 166. As shown in phantom lines in FIG. 18 of the preferred embodiment, the lid 166 includes a corrugated lid support strip 199 extending across and secured to the inner surface at about the center of the lid center panel 193 and extending downwardly secured to the inner surface of the opposing vertical lid panels 92 to provide additional structural support for stacking of the full container packs 158.

The leg wrap pallet 130 is set inside of the tray 164. The side panels 174 are positioned in a tray 164 between the side walls of the leg wrap pallet 130 and the interior surface of the tray lip 188 so that the vertical edges of the side panels 180 of the side wall sheets 174 overlap one another. A die cut tray reinforcement sheet 200 having cutouts 202 to facilitate the tines of a fork lift is placed inbetween the interior surface of the trap lip 188 and the exterior surface of the side wall sheets 174 to provide structural support and rigidity to the structure.

Figure 28:
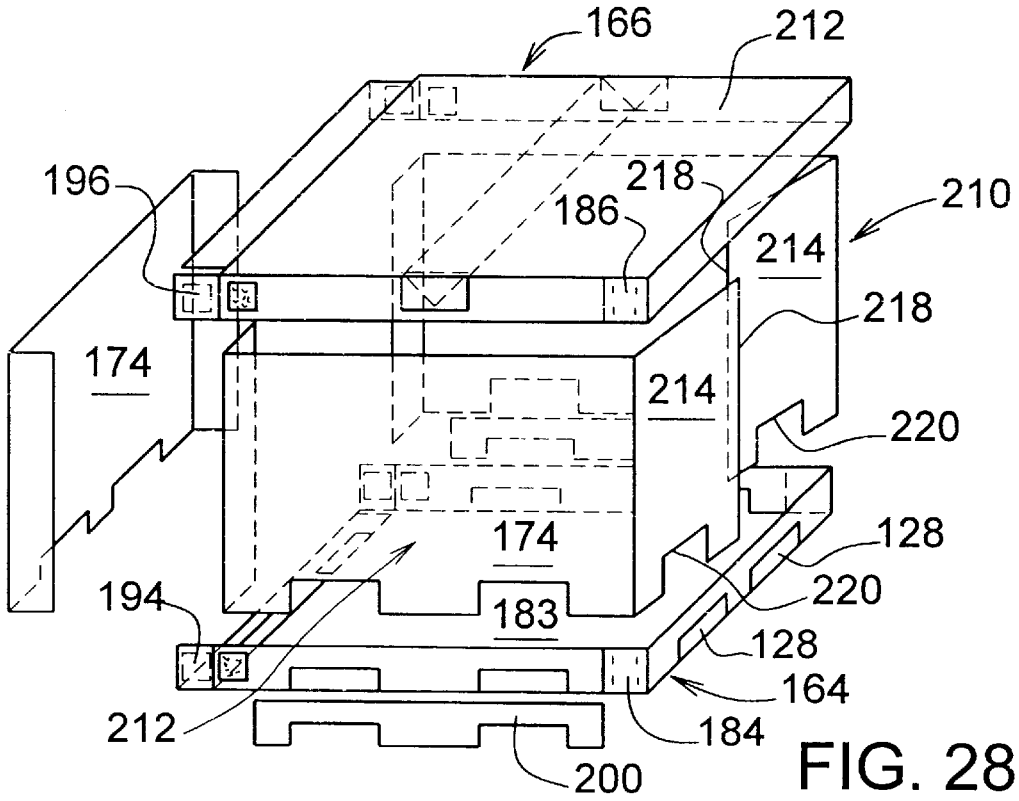
FIG. 28 is an exploded perspective view showing the internal components in phantom view.

FIG. 28 shows an alternate embodiment wherein only three sheets are used to provide the sidewalls of the container pack 210. One removable sidewall sheet 174 as described heretofore is used in combination with two wraparound side wall sheets 212. The wraparound sidewall sheets 212 consist of a sidewall sheet 174 having score lines to facilitate bending the sheet forming corners 216 and forming end panels 214 attached thereto or formed thereon so that the distal end vertical edges 218 of each of the wraparound sidewall sheets 212 meet in the center. Each of the end panels have a cutaway portion 220 at the bottom for alignment with the cutaways 128 formed in the leg wrap supports 106 or in alignment with the spacing between the leg wrap supports 106. Of course, it is contemplated that the single side wall sheet 174 could also be eliminated each wraparound sidewall sheet 212 could utilize a second opposing end panel 214; however, the convenience of side entry would be eliminated, and side access is an important feature of the present invention.

It is contemplated that the vertical support members 162 could be cut to a selected length so that two or more would fit end to end in the corners of the container pack 158 between the interior surface of the corner of the tray 164 and/or lid 166 and the exterior surface of the corners of the side wall sheets 174 and secured in place by a friction fit of other holding means such as an adhesive or staples; however, the additional support is usually not necessary to obtain a solid fit.

As shown in FIGS. 23, 27, 29–30, a folded corrugated panel or compressible strip 204 may also be used in the corners of the container pack 158 between the interior surface of the corner of the tray 164 and/or lid 166 as a cushioning means, and around the exterior surface of the corners of the side wall sheets 174 as a protective means secured in place by a friction fit or other holding means such as an adhesive, staples or strap.

As shown in FIGS. 21 and 22, a separation panel 204 having spaced apart fingers 206 may be fabricated by using multi-ply corrugated board strips 208 having a plurality of notches cut therein at selected positions forming fingers thereinbetween. The corrugated board strips 208 shown in separation panel 204 consists of two strips secured normal to a corrugated sheet; however, a plurality of board strips 208 may be used to separate and hold material in place. The separation panel 204 may simply be placed onto the surface of the pallet 130 within the tray and/or inverted and placed over the articles to be held in position within the container pack 158 and held into position by the lid 166.

Figure 27:
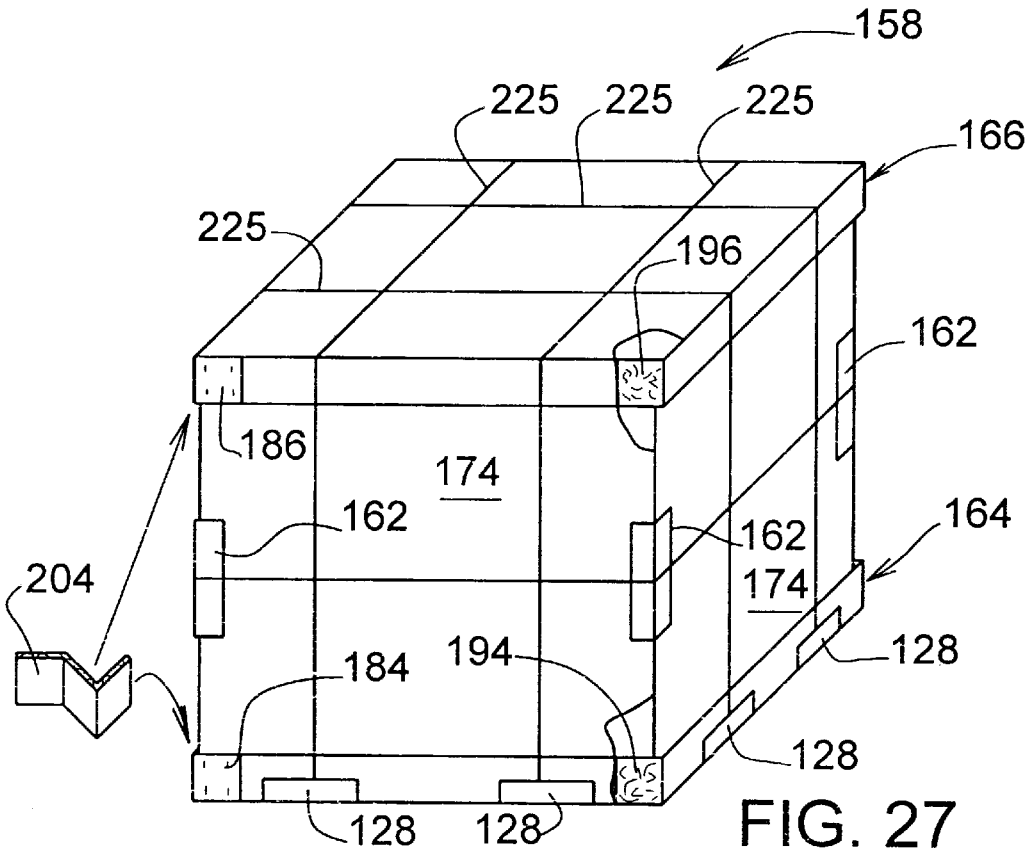
FIG. 27 is a perspective and partial cutaway view of an erected corrugated collapsible container pack showing the use of spacer sheets, the side access and vertical supports used in combination with banding.
Figure 29:
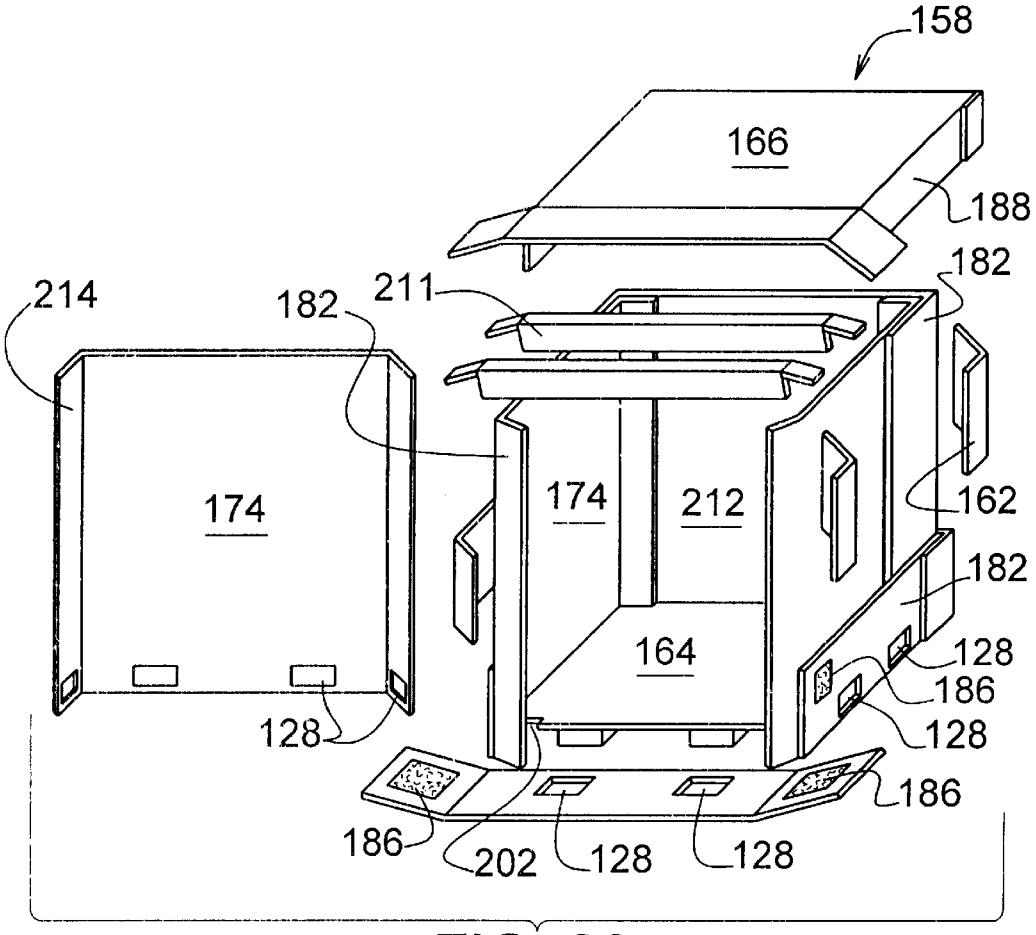
FIG. 29 is an exploded view of the collapsible container pack of FIG. 28 utilizing horizontal support members in the top and corner protector strips.
Figure 32:
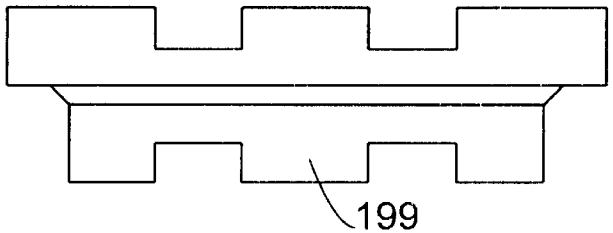
FIG. 32 is a front view of showing a tray protector for use with the present invention.
Figure 33:
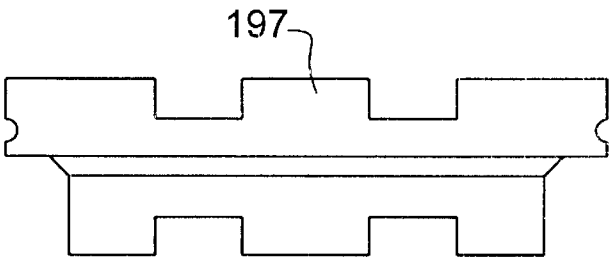
FIG. 33 is a front view of an alternate embodiment of a tray protector for use with the present invention.

A completed corrugated collapsible container pack 158 is shown erected in FIG. 26 and 27 wherein secured lid corners 194 and secured tray corners 184 are positioned on the right side and the detachable lid corners 196 and detachable tray corners 186 are positioned on the left side. The corrugated collapsible container pack 158 shown erected in FIG. 27 utilizes the vertical support members 162, which supported the lid 166 in the collapsed position, as cushion means to provide extra protection from the banding strips 225 used to hold the lid 166 to the body of the corrugated collapsible container pack 158. Moreover, tray protectors 197 and 199, such as shown in FIG. 29 may provide an optional means of protecting the tray and/or lid from strap 225 damage.

Assembly of the corrugated collapsible container is simple. As best illustrated in FIG. 29, take the lid off of the collapsed pack and remove all of the parts from the pack. Insert the long side panels into the bottom tray so that the cutouts on the bottom tray will meet the cutouts on the side panels. Put the end panel in the back of the bottom tray where the flaps are stapled and glued. The front of the pack has flaps with hook and loop fasteners that meet and close the bottom tray. Place the top spreader bars 211 or led support members in line with the score lines of the two side panels. Place the lid on the top of the two side panels and the end panel. The hook and loop fasteners are in the front, and the stapled and glued flaps will be in the back matching up with the bottom tray in accordance with the illustration. The front hook and loop secured flaps can be held open for loading household goods into the pack. After loading the pack, put the front panel to the front of the pack to fit making sure the cutouts of the front panel meet the cutouts on the bottom tray. The flaps of the front panel will fit inside both the bottom tray flaps and the top lid flaps. To close the unit, fold the top lid flaps down the bottom tray flaps up securing them with the hook and loop fasteners.

Figure 30:
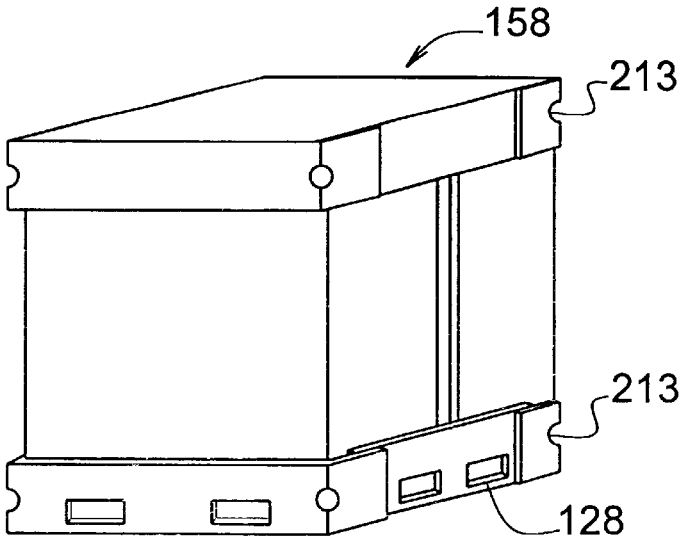
FIG. 30 is a perspective view of the collapsible container pack of FIG. 29 in the closed configuration.
Figure 31:
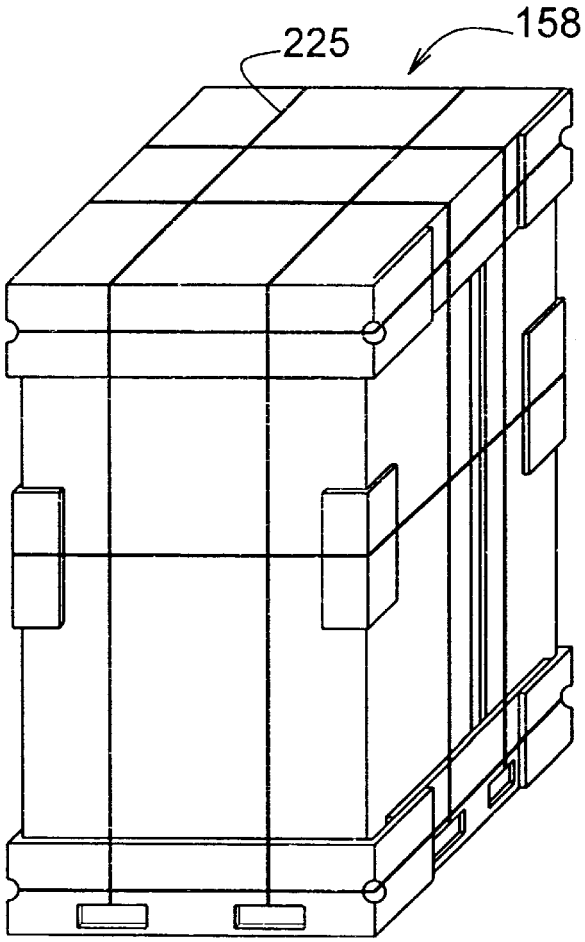
FIG. 31 is a perspective view of the collapsible container pack of FIG. 31 utilizing a plurality of straps.

The finished corrugated collapsible container will appear as shown in FIG. 30. Additional structural strength can be provided by running a band horizontally around the top lid making sure that the banding locates in the small cutouts 213 formed in the lid as shown in FIG. 31. A band can also be run horizontally around the bottom tray. Another centered horizontal band can be extended around the container and supported by the corner protector strips. A pair of straps can then be run around the length and height of the container, and around the length and width of the container.

Any of the container packs 158 can be formed having removable opposing ends, whereby the front wall panel and/or the rear wall panel can be removably secured by releasable lid panels and releasable tray panels.

Reference to documents made in the specification is intended to result in such patents or literature cited are expressly incorporated herein by reference, including any patents or other literature references cited within such documents as if fully set forth in this specification.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

We claim:

1. A corrugated collapsible container pack, comprising:

a base tray comprising a front tray panel releasably attaching to a pair of tray side panels connecting to a rear tray panel, each connecting to a floor panel disposed thereinbetween;

means for releasably holding said front tray panel to said tray side panels;

a front wall panel removably attaching to a pair of side wall panels connecting to a back wall panel;

means for releasably holding said front wall panel to said side wall panels;

a lid having side edges bent downwardly forming a lid front panel releasably attaching to a pair of lid side panels connecting to a lid rear panel, each connecting to a top cover panel disposed thereinbetween;

means for releasably holding said front lid panel to said pair of lid side panels; and said releasable front tray panel and said releasable front lid panel being in alignment one with the other defining means for releasing said removable front wall panel providing access to the contents stored within said corrugated collapsible container pack during the erect position without removing said lid.

2. The corrugated collapsible container pack of claim 1, including a pallet being positioned within said base tray.

3. The corrugated collapsible container pack of claim 2, said pallet including at least one leg wrap support member comprising a sheet of corrugated material being folded inwardly forming at least four panels defining a generally rectangular shaped conduit and means for holding said panels together.

4. The corrugated collapsible container pack of claim 3, wherein said sheet wrapping around at least one corrugated support member disposed therein folded into a generally square configuration having flutes defining a top fluted edge and a bottom fluted edge oriented normal to and contiguous with a top cover panel and a bottom panel of said sheet.

5. The corrugated collapsible container pack of claim 3, said leg wrap support including at least one pair of spaced apart and aligned transverse slots formed therethrough for cooperative engagement with the tines of a fork lift.

6. The corrugated collapsible container pack of claim 5, said pallet including at least one pair of spaced apart and aligned transverse slots formed therethrough for cooperative engagement with the tines of a fork lift.

7. The corrugated collapsible container pack of claim 2, wherein said pallet comprises corrugated material.

8. The corrugated collapsible container pack of claim 1, said back wall panel is integrally connecting to said pair of side wall panels.

9. The corrugated collapsible container pack of claim 1, wherein said means for releasably attaching said front type panel to said tray front panel comprises a hook and loop fastener.

10. The corrugated collapsible container pack of claim 1, wherein said means for releasably holding said front lid panel to said pair of lid side panels comprises a hook and loop fastener.

11. The corrugated collapsible container pack of claim 1, wherein said means for releasably holding said front wall panel to said side wall panels comprises a hook and loop fastener.

12. The corrugated collapsible container pack of claim 1, including a means of supporting disposed between said side wall panels.

13. The corrugated collapsible container pack of claim 12, wherein said means of support disposed between said side wall panels comprises at least one longitudinal member.

14. The corrugated collapsible container pack of claim 13, wherein said at least one longitudinal member comprises corrugated material.

15. The corrugated collapsible container pack of claim 13, wherein said at least one longitudinal member defines a spreader bar comprising a sheet of corrugated material having at least three panels connecting together forming a conduit member.

16. The corrugated collapsible container pack of claim 1, said base tray, said side wall panels, said back wall panel, and said front wall panel including at least one pair of spaced apart and aligned transverse slots formed therethrough for cooperative engagement with the tines of a fork lift.

17. The corrugated collapsible container pack of claim 1, including means for supporting said lid in the collapsed position in cooperative engagement with said base tray.

18. The corrugated collapsible container pack of claim 17, wherein said means for supporting said lid in the collapsed position in cooperative engagement with said base tray comprises a plurality of longitudinal strips of material having a ninety degree bend extending the length of said longitudinal strip of material defining a corner strip.

19. The corrugated collapsible container pack of claim 17, wherein said longitudinal strips are formed of corrugated material.

20. The corrugated collapsible container pack of claim 17, said longitudinal strips being positioned along the edges of said corrugated collapsible container pack upon erection thereof reinforcing said edges and providing protection from tie bands extending around said corrugated collapsible container.

21. The corrugated collapsible container pack of claim 1, said front wall panel, said pair of side wall panels and said back wall panel collapse and fold within said bottom tray, wherein said lid cooperatively engages said bottom tray in the collapsed position.

22. The corrugated collapsible container pack of claim 21, including a pallet disposed within said bottom tray.

23. The corrugated collapsible container pack of claim 1, said lid rear panel removably attaching to said pair of lid side panels, said back wall panel removably attaching to said pair of side wall panels, and said rear tray panel removably attaching to said tray side panels.

24. The corrugated collapsible container pack of claim 1, wherein said front wall panel or said rear wall panel include vertical creases near the outer edge thereof forming side flaps cooperatively engaging with said side wall panels.

25. The corrugated collapsible container pack of claim 1, wherein said front wall panel or said rear wall panel include vertical creases near the outer edge thereof forming side flaps for cooperatively engaging with said side wall panels.

26. The corrugated collapsible container pack of claim 1 including a water resistant coating.

27. A corrugated collapsible container pack, comprising:

a base tray comprising a front tray panel and a back tray panel releasably attaching to a pair of tray side panels releasably attaching to a rear tray panel, each connecting to a floor panel disposed thereinbetween;

means for releasably holding said front tray panel and rear tray panel to said tray side panels;

a front wall panel and a back wall panel removably attaching to a pair of side wall panels connecting to a back wall panel;

means for releasably holding said front wall panel and said back wall panel to said pair of side wall panels; and a lid having side edges bent downwardly forming a lid front panel releasably attaching to a pair of lid side panels releasably attaching to a lid rear panel, each connecting to a top cover panel disposed thereinbetween said releasable front tray panel and said releasable front lid panel being in alignment one with the other, and said releasable rear tray panel and said releasable rear lid panel defining means for releasing either said removable front wall panel or said removable back wall panel providing access to the contents stored within said corrugated collapsible container pack during the erect position.

28. The corrugated collapsible container pack of claim 27, including means for releasably holding said front lid panel to said pair of lid side panels.

29. The corrugated collapsible container pack of claim 27, wherein said means for releasably holding said front lid panel to said lid side wall panels comprises a hook and loop fastener.

30. The corrugated collapsible container pack of claim 27, including a pallet being positioned within said base tray.

31. The corrugated collapsible container pack of claim 30, wherein said pallet comprises corrugated material.

32. The corrugated collapsible container pack of claim 30, said pallet including at least one leg wrap support member comprising a sheet of corrugated material being folded inwardly forming at least four panels defining a generally rectangular shaped conduit including means for holding said panels together, including at least one support member disposed within said at least one leg wrap support, said at least one support member defining a generally square configuration having flutes defining a top fluted edge and a bottom fluted edge oriented normal to and contiguous with a top cover panel of said sheet.

33. The corrugated collapsible container pack of claim 27, said rear wall panel and said pair of side wall panels are formed from a single sheet of corrugated material.

34. The corrugated collapsible container pack of claim 27, wherein said means for releasably holding said front tray panel and rear tray panel to said tray side panels comprises a hook and loop fastener.

35. The corrugated collapsible container pack of claim 27, wherein said means for releasably holding said front wall panel and said back wall panel to said side wall panels comprises a hook and loop fastener.

36. The corrugated collapsible container pack of claim 27, including means of supporting said lid and said side wall panels disposed between said side wall panels.

37. The corrugated collapsible container pack of claim 36, wherein said means of supporting disposed between said wall panels comprises at least one longitudinal member.

38. The corrugated collapsible container pack of claim 27, including means for supporting said lid in the collapsed position in cooperative engagement with said base tray comprises a plurality of longitudinal strips of corrugated material having a ninety degree bend extending the length of said longitudinal strip of material defining a corner strip.

39. A corrugated collapsible container pack, comprising:

a tray having a plurality of side edges bent upwardly forming four vertical tray side panels and a central floor panel permanently attaching three of said four tray side panels forming two secured corners and removably attaching said remaining tray side panel with means for releasably securing said adjacent ray side panels forming a pair of detachable corners;

a pallet positioned with said tray;

side wall sheets having a central panel and a pair of side panels disposed between said pallet and said tray;

a lid having a plurality of side edges bent upwardly forming four vertical lid side panels and a central top cover panel, permanently attaching three of said four lid side panels forming two secured corners and removably attaching said remaining lid side panel with means for removably securing said adjacent lid side panels forming a pair of detachable corners, said lid being placed over the top of said side wall sheets;

a plurality of vertical support members for supporting said lid in the collapsed position in cooperative engagement with said tray, enclosing said side wall sheets therein; and said detachable tray corners and said detachable lid corners being in alignment one with the other defining means for releasing said detachable lid corners of said vertical tray panel and said vertical lid panel for removing one of said side wall sheets and providing side access to the contents stored with said corrugated collapsible container pack during the erect position without removing said lid.

40. The corrugated collapsible container pack of claim 39, wherein said pallet comprises corrugated material.

41. The corrugated collapsible container pack of claim 39, wherein said means for releasably securing said lid side panels to said lid front panel comprises a hook and loop fastener.

42. The corrugated collapsible container pack of claim 39, wherein said means for releasably securing said side wall panels to said front wall panel comprises a hook and loop fastener.

43. The corrugated collapsible container pack of claim 39 including means of supporting disposed between said wall panels comprising at least one longitudinal member.

44. The corrugated collapsible container pack of claim 39, including means for supporting said lid in the collapsed position in cooperative engagement with said base tray.

45. The corrugated collapsible container pack of claim 44, wherein said means for supporting said lid comprises a plurality of longitudinal strips of corrugated material.

46. The corrugated collapsible container pack of claim 45, wherein said plurality of longitudinal strips of corrugated material may be bent along the vertical longitudinal axis forming a corner strip for reinforcing said corrugated collapsible container pack and providing reinforcement and cushioning for banding.

47. The corrugated collapsible container pack of claim 39, said pallet including at least one leg wrap support member comprising a sheet of corrugated material being folded inwardly forming at least four panels defining a generally rectangular shaped conduit including means for holding said panels together, including at least one support member disposed within said at least one leg wrap support, said at least one support member defining a generally square configuration having flutes defining a top fluted edge and a bottom fluted edge oriented normal to and contiguous with a top cover panel of said sheet.

48. The corrugated collapsible container pack of claim 39 including a water resistant coating.

* * * * *